US006253384B1

(12) United States Patent
Valentino

(10) Patent No.: US 6,253,384 B1
(45) Date of Patent: Jul. 3, 2001

(54) PARTIAL, REMOVABLE, REUSABLE WAISTBAND AND ITS HOLDER

(76) Inventor: Peter J. Valentino, 510 E. 27th St., Apt. 2G, Paterson, NJ (US) 07514

( * ) Notice: Subject to any disclaimer, the term of this patent is extended or adjusted under 35 U.S.C. 154(b) by 0 days.

(21) Appl. No.: 09/648,800

(22) Filed: Aug. 28, 2000

(51) Int. Cl.[7] ..... A41D 1/06

(52) U.S. Cl. ..... 2/229; 2/309

(58) Field of Search ..... 2/311, 94, 117, 2/2.5, 908, 80, 83, 227, 229, 78.4, 309–310, 16, 22, 170, 338, 242; 43/114, 115, 121, 136

(56) References Cited

U.S. PATENT DOCUMENTS

| | | | | |
|---|---|---|---|---|
| 233,414 | * | 10/1880 | Hays | 2/338 |
| 1,249,108 | * | 12/1917 | Jones | 2/229 |
| 2,030,135 | * | 2/1936 | Carpenter | 24/67 |
| 2,663,027 | | 12/1953 | Posson . | |
| 2,806,225 | | 9/1957 | Singer . | |
| 2,905,948 | | 9/1959 | Grisanti . | |
| 2,946,064 | | 7/1960 | Dieterle . | |
| 3,027,566 | | 4/1962 | Ruby . | |
| 3,076,201 | | 2/1963 | Winter . | |
| 4,089,068 | | 5/1978 | Swallow . | |
| 4,480,339 | | 11/1984 | Hubbard . | |
| 4,498,201 | | 2/1985 | Carter . | |
| 4,549,317 | | 10/1985 | D'Ambrosio . | |
| 4,677,699 | | 7/1987 | Barabe . | |
| 4,800,594 | | 1/1989 | Young . | |
| 4,890,337 | | 1/1990 | Greenberg . | |
| 5,016,291 | | 5/1991 | Capper . | |
| 5,123,120 | * | 6/1992 | Ross | 2/229 |
| 5,155,950 | * | 10/1992 | Burgeson | 43/121 |
| 5,182,812 | * | 2/1993 | Goldsby | 2/79 |
| 5,304,162 | | 4/1994 | Kuen . | |
| 5,381,557 | * | 1/1995 | Luria et al. | 2/16 |
| 5,495,621 | * | 3/1996 | Kibbee | 2/2.5 |
| 5,544,366 | | 8/1996 | Kato . | |
| 5,638,550 | | 6/1997 | Hube . | |
| 5,717,999 | * | 2/1998 | Lurry | 2/69 |
| 5,754,982 | * | 5/1998 | Gainer | 2/2.5 |
| 5,866,070 | * | 2/1999 | Watanabe et al. | 422/40 |
| 6,088,831 | * | 7/2000 | Jensen et al. | 2/2.5 |

* cited by examiner

*Primary Examiner*—John J. Calvert
*Assistant Examiner*—Tejash Patel

(57) ABSTRACT

A waistband is disclosed herein for use in maintaining articles of clothing in place while being worn, and which includes a partial waistband having a clothes engaging adhesive on opposite sides thereof for removable, adhesive engagement with the clothing. A container is supplied for storage of said waistband when not in use.

5 Claims, 1 Drawing Sheet

PARTIAL, REMOVABLE, REUSABLE WAISTBAND AND ITS HOLDER

BACKGROUND OF THE INVENTION

1. Field of the Invention

The present invention relates to the field of garment or clothes retainers, and more particularly to a novel, partial waistbelt useful in maintaining the wearer's clothes in place so as to prevent inadvertent dislodgement or displacement of clothing as it is worn.

2. Brief Description of the Prior Art

In the past, numerous problems and difficulties have been encountered by both men and women when wearing separate clothing such as shirts and trousers for a man and blouses and skirts for a woman. These problems stem largely from the fact that as the wearer moves and manipulates his or her body, the shirt or blouse has a tendency to "ride" or substantially move with respect to the trousers or skirt so that in many instances, the shirt or blouse will have a disheveled and unsightly look due to unwanted excess of material outside of the trouser or skirt. One attempt has been made to maintain or retain the shirt or blouse in proper position with respect to a trouser or skirt which includes tufted material placed on the inside waist portion of the trousers or skirt so that it will provide a frictional engagement with the surface of the shirt or blouse against which it bears. However, such a construction of the trouser or skirt is expensive and must be done by the original manufacturer. In those instances where no such frictional means has been originally provided in the garment, the above-noted problem still exists.

Also, a single waistbelt having a friction surface on one side has been used. Since the smooth side of the belt permits unwanted gathering of the material or pulling out of the material from the waistband of the trouser or skirt, it has been proven inoperative and unacceptable for its intended purpose.

The cut of many trousers, for both males and females, results in a waistband which is positioned approximately at the waist of the wearer, i.e., above the wearer's hips. Whether or not a belt is worn, the full weight of the trousers must be supported from the waistband. The waistband must be tightened against the stomach sufficiently to support the trousers, or the trousers will have a tendency to slip down so that the waistband rests on the wearer's hips. These trousers often have an unfashionable look if they are worn other than where intended, and can be unsightly and uncomfortable when a belt is tightly cinched around the waist. Both problems are especially acute for many overweight persons, especially those with protruding stomachs. In order to support the trousers in approximately the desired position, the waistband must be belted quite tightly, or the front portion of the trousers raised to where they will rest on the upper side of the stomach bulge. Otherwise, the waistband of the trousers tends to slip down in front to a position generally below the stomach bulge. This results in the trousers hanging improperly throughout their length, with the waistband being lower in front than in back.

Attempts have been made to overcome this problem in the past, for example the "Napped Elastic Waistband", U.S. Pat. No. 5,016,291. Perhaps the best known example is the development of suspenders, which transfer the weight of the trousers to the shoulders while holding the waistband relatively level. The use of suspenders has a number of obvious drawbacks, including the fact that the suspenders are visible unless covered by a coat or other garment. Further drawbacks include the fact that the elastic material which generally must be used for suspenders can stretch or can be pulled out of shape, and the trousers may "ride up" in back when the wearer bends over. Additionally, many people are uncomfortable with the fact that the weight is being supported from the shoulders rather than at the waist/hip region of the body.

Various attempts have been made to provide a supporting device in which the weight of the trousers is supported on the hips while the waistband remains at the wearer's waist level. These attempts have included, for example, the use of long flexible rods which wrap around the wearer's hips and attach to the waistband at various points. Other attempted solutions to this problem include the use of a lower belt worn around the hips. Such an apparatus employs a plurality of stiff vertical members coupled to a second belt, which is in turn attached to the waistband of the trousers.

The solutions proposed by the prior art have several important drawbacks. Such previous solutions are difficult to adjust to various sizes. Devices presently known in the art are difficult and cumbersome to use, and are complicated in construction. This complexity deters the use of such devices, and makes them expensive to produce. Present devices are generally uncomfortable to wear, and some have relatively large mechanical parts which show through the trousers.

Therefore, a long-standing need has existed to provide a novel waistband which may be worn between the inside waist portion of a trouser or skirt and the outside portion of a shirt or blouse so that the shirt or blouse will not gather or ride out of position as the wearer moves his or her body about. Such a retainer must be operable whether the composition of the shirt or blouse is of a cotton, wool or slippery silk material.

SUMMARY OF THE INVENTION

Accordingly, the above problems and difficulties are obviated by the present invention which provides a novel adhesive, partial waistband. The waistband can readily accommodate the various girths of the wearer. A special feature of the present invention provides that the opposite sides of the partial waistband be adhesive to provide adhesive surfaces that will simultaneously engage with the inside waist portion of a trouser or skirt and with the outside surface of a shirt or a blouse. Therefore, it is among the primary objects of the present invention to provide a novel retaining means for resisting displacement of adjacent garments, such as shirts and blouses, with respect to trousers and skirts, so that movement of the wearer will not displace the garments with respect to each other.

An object of the present invention is to provide a trouser support device which causes the weight of the trousers to rest partially on the wearer's upper garment.

A further object that such a trouser support device be simple to put on, comfortable to wear and inexpensive to manufacture. It is another object that such a support device not be visible when used.

Another object of the present invention is to provide a novel waistband having opposite surfaces which include adhesive means for simultaneously engaging with opposing surfaces of garments worn by a wearer in order to prevent displacement of the garments with respect to each other.

Another object of the present invention is to provide a simple, inexpensive, removable and reusable means for preventing shirt or blouse displacement with respect to trousers or skirts by employing a double surface adhesive waistband engageable with both the shirt or blouse with the respective trouser or skirt so as to prevent displacement or gathering of material there between.

Yet a further object of the present invention is to provide an operable waistband for preventing displacement of garments that are simultaneously worn that would otherwise work themselves separate following the movements of the wearer.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
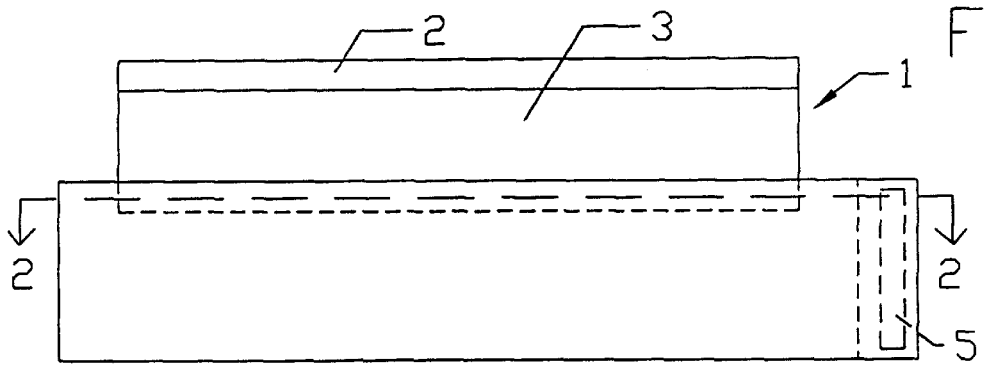
FIG. 1 is a side view of the partial waistband of the present invention partially inserted into its storage container.
Figure 2:
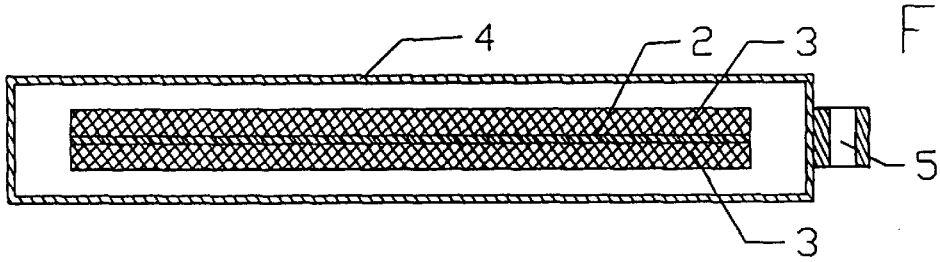
FIG. 2 is a cross-sectional view of the waistband and container, shown in FIG. 1, taken in the direction of arrows 2—2 thereof.

Referring to FIG. 1, the reusable, partial waistband 1 and storage container 4 of the present invention are illustrated in the general direction of arrows 1 and 4. Partial waistband 1 includes an band 2 partially covered on both sides with adhesive material 3. In a well known manner, partial waistband 1 is designed, to be interposed between a lower garment, as a trousers or a skirt, and upper garment, as a shirt or a blouse so that when so positioned between said upper and lower garments, said upper garment, supports said lower garment, and said waistband keeps said garments together during use not shown.

As illustrated in FIG. 1, it is preferred that a top portion of band 2, of said partial waistband 1, be free of adhesive material 3 to provide an adhesive free area for manipulating and positioning partial waistband 1.

When not in use, said partial waistband 1 is designed to be stored in container 4. Container 4 is fabricated of a material that does not bind to adhesive material 3. Alternately, container 4 may be fabricated of any suitable material and lined with said non binding material (not shown).

At least one end of container 4 is provided with an opening to facilitate the storage of container 4 on a closet hook or the like (not shown).

There are many well known manufacturers of two sided adhesive tape and anti-stick material. For example, Product "#451 double coated vinyl 2.5"×36 yd." and "#456B double coated polyester 2.5"×36 yd." tape manufactured by CAN-DO NATIONAL TAPE, Nashville, Tenn. 37210.

In use, the appearance of the garments are greatly improved because they are worn as the designer intended, with no obvious extra support.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A removable, reusable, partial waistband interposed between a lower garment and an upper garment which comprises:

where said reusable, partial waistband is flat with two opposing sides and is fabricated to secure said lower garment to said upper garment, where said opposing sides of said partial, waistband include a coating of an adhesive material, where, when in use positioned between said upper and lower garments, said partial waistband adheres to said upper garment, and said lower garment and keeps said garments together during use, and a container, lined with a material which does not bind to said adhesive material for storing said partial waistband, when said partial waistband is not in use.

2. A partial waistbelt designed to maintain the upper and lower garments of a wearer's clothing in place so as to prevent inadvertent dislodgement or displacement of said clothing as it is worn which comprises:

a flat, partial waistbelt with, at least, two opposing sides, an adhesive coating on said opposing sides of said partial waistbelt to provide adhesive surfaces which can simultaneously engage said lower garment and said upper garment.

3. A partial waistbelt, according to claim 2, which includes:

where said waistbelt is removable and can be reused, at least, once.

4. A partial waistbelt, according to claim 3, which includes:

a container where the inside of said container is fabricated of a material that does not bind to said adhesive coating, and where said container is designed to store said partial waistbelt when not in use.

5. A partial waistbelt, according to claim 2, which includes:

where, to facilitate the engagement, removal and storage of said waistbelt, portions of said opposite sides of said partial waistbelt are not coated with said adhesive.

* * * * *